US005520291A

United States Patent [19]

Graham

[11] Patent Number: 5,520,291

[45] Date of Patent: May 28, 1996

[54] PARTITIONED LOCKING RACK

[76] Inventor: Don S. Graham, 2737 S. Broadway, Tyler, Tex. 75701

[21] Appl. No.: 281,420

[22] Filed: Jul. 27, 1994

[51] Int. Cl.[6] ..... A47F 5/00

[52] U.S. Cl. ..... 211/4; 211/64; 211/70.5; 70/58

[58] Field of Search ..... 211/64, 4, 70.5; 70/58

[56] References Cited

U.S. PATENT DOCUMENTS

| | | | |
|---|---|---|---|
| 1,951,255 | 3/1934 | Parker | 211/64 |
| 2,958,423 | 11/1960 | Caloiero et al. | 211/64 X |
| 3,180,494 | 4/1965 | Levy | 211/64 |
| 4,113,107 | 9/1978 | Jaeger | 211/64 X |
| 4,139,100 | 2/1979 | Reed | 211/64 X |
| 4,696,405 | 9/1987 | Waring | 211/64 X |
| 5,265,950 | 11/1993 | Atkinson | 211/64 X |
| 5,287,972 | 2/1994 | Saathoff | 211/64 |

*Primary Examiner*—Robert W. Gibson, Jr.

*Attorney, Agent, or Firm*—Ronald B. Sefrna; Charles W. Alworth

[57] ABSTRACT

A high security, inexpensive and versatile manner of locking firearms within a theft proof gun rack. The apparatus comes in two embodiments for use with long guns or pistols and utilizes a locking bar which locks the firearm within a given partition within the gun rack. The long gun embodiment of the apparatus accepts various sized guns, either in or out of soft gun cases, by using an optional spacer to accept smaller guns within the rack. The apparatus is designed to be mounted to a wall or similar object and, once a firearm is in place and locked, the mounting bolts are unreachable. Protection of the finish of the firearm is afforded by a resilient covering on all parts of the rack which come in contact with the firearm.

24 Claims, 8 Drawing Sheets

PARTITIONED LOCKING RACK

TECHNICAL FIELD OF THE INVENTION

The instant invention generally relates to the field including apparatus for the storage of firearms, and more specifically relates to an apparatus designed to be mounted to a wall or similar object to securely retain and prevent unauthorized removal of one or more firearms secured in the apparatus.

BACKGROUND OF THE INVENTION

Many individuals and organizations maintain and store firearms usually in some form of locking device to provide a certain amount of security for the weapon or weapons. The security requirements are to prevent unauthorized use and theft of the weapon or weapons. In particular the home is vulnerable to robbery and subsequent theft of any weapons or the weapon could be used on the homeowner by the robber. Usually, the owner will store firearms in a locking rack that is generally made of wood and offers very little security for the contained weapon. Most gun racks are loosely attached to a wall or similar object which means that the entire gun rack may be taken for later removal of the contained firearms.

PRIOR ART

The prior art is rife with various forms of firearm racks and security methods; however, the majority of the prior art is concerned with secure display of the firearms rather than the secure storage of firearms out of sight. Generally, the prior art uses wood racks for two reasons: the first being to protect the firearm by providing a relatively soft containment housing, and the second being for esthetic values because, generally, the firearms are on display.

U.S. Pat. No. 2,752,046 (Levy) discloses a Vertical Type Gun Rack that utilizes wood as its structural element. Levy teaches display of the gun mounted in his apparatus and discloses a lockable circular bar which passes across the stock of each gun to restrain, from unauthorized use, the guns within the rack. The rack is partitioned into sections with each section holding an individual gun. The locking circular bar is controlled by a sliding drawer under the gun rack such that, when the drawer is closed and locked, the bar is latched in place. Close examination of the disclosure reveals that the locking mechanism requires that each gun stock have substantially the same dimensions, otherwise, it could be possible to remove a gun with the locking bar in place. For example, if a gun owner had a gun with a large stock and one with a small stock, the size of Levy's apparatus would be set by the gun with the large stock and the gun with the small stock could be slipped out of the locked rack. It would be possible to let the gun, with the small stock, set the size of the gun and physically enlarge one section to accept the gun with the larger stock; however, this would require substantial re-working of the grill rack.

U.S. Pat. No. 2,958,422 (Caloiero et al.) discloses a Vertical Gun Rack that also utilizes wood as its structural element. Caloiero utilizes a lockable bar which passes across the stock of each gun to restrain, from unauthorized use, the guns within the rack. Unlike Levy, Caloiero does not use sections with the gun rack, but utilizes slots in the base of the rack to accept the gun stock and openings in the top of the rack to accept the gun barrel. Caloiero requires that all contained guns have approximately the same dimensions near that point at which the locking bar passes in front of the guns; otherwise, it would be possible to slip a smaller gun up and past the locking bar.

U.S. Pat. No. 4,113,107 (Jaeger) discloses a Machine Gun Rack which is most likely fashioned from metal although the structure could utilize wood. The machine gun rack is partitioned into sections with each section designed to hold a similar machine gun; thus, the disclosure teaches a device for use with similar sized guns. Jaeger uses two locking bars, one across the top of the gun and one which runs through each trigger guard on each contained gun. The lower bar, running through each trigger guard, limits this gun rack to only contain guns specifically suited to fit the rack; otherwise, a non-standard gun would interfere with the locking mechanism or not be properly secured from unauthorized use. There is no doubt that this apparatus provides excellent protection for the contained firearms, but the cost of such a device would be beyond the means of the ordinary gun owner.

U.S. Pat. No. 4,132,315 (Young) discloses a Security Rack for Weapons fashioned from metal that is designed to secure variable length weapons. The apparatus resolves a number of problems found in the art, but is a complex device. The gun is held in place within the gun rack by an adjustable butt housing and the gun is secured by a tongue which closes across an upper slotted gun restraint thus providing a locking restraint. Because the device is complex, the cost will be high and will be beyond the means of the ordinary gun owner.

U.S. Pat. No. 4,174,042 (Fair) discloses a Gun Locking Device fashioned from a combination of materials that is also designed to secure variable length guns. The apparatus like that of Young resolves a number of prior art deficiencies, but like Young is somewhat complex. The restrained gun fits in a butt slot within the rack and has an upper slidable section that moves downward to grip the end of the protruding barrel. The slidable section can be locked in place by a sliding lever which is, in turn, locked in place by a padlock.

U.S. Pat. No. 4,461,385 (Clouser) discloses Locking Gun Racks, fashioned mainly of wood, which are inexpensive gun racks to provide reasonable security for firearms contained within the devices. The wooden racks are designed to be bolted against a wall so that the complete rack cannot readily be moved. The same retaining bolts also constrain a chain that is designed to be passed through the trigger guard on each gun within the rack. The chain is then padlocked in place. This device is inexpensive, but being made of wood, can readily be forced open. The wall attachment bolts can be reached by the potential thief by simply using a saw to cut through or around a wooden plug which protects, or hides, the bolt head. All that is required to remove a gun (or all guns) is to remove one or the other attachment bolt which then releases the security chain. The padlock or chain can readily be cut by bolt cutters.

Many owners of guns store their long rifles, as well as shot guns, in soft carrying cases. These cases afford a certain degree of protection for the subject gun in that the case will keep dust, grit, moisture and the like away from the gun. Very often the gun owner will have some guns in soft cases and other guns without cases that need to be secured. This means that a variable sized firearm (with or without soft case) needs to be stored in a gun rack. The prior art cannot readily meet this requirement. Thus, there remains a need for a simple, inexpensive and readily adjustable gun rack that can securely rack guns of varying sizes with and without soft cases: a device that will severely curtail theft of guns, but that can easily be opened or locked; and a device that can store long rifles or pistols safely and without damage to the firearm.

SUMMARY OF THE INVENTION

The gun rack of the instant invention is available in two basic forms; one for long guns and the other for short guns (pistols or hand guns) and is generally formed from a U-shaped steel back plate which is designed to be securely mounted to a wall, the studs in a wall, or the like (preferably out of sight) by suitable bolts. The back plate is partitioned into sections or stalls to hold individual firearms. Once the rack is mounted to a suitable retaining wall, filled with firearms and locked, it becomes impossible to reach the attachment bolts. The locking feature is provided by a bar which is slideably positioned between the two sides of the U-shaped steel back plate or frame, covers the firearm, and retained in its locked position by a padlock or similar lock. All parts of the gun rack that may come in contact with any part of a contained firearm are covered with rubber (or similar material) or dipped in a rubber/plastic coating to prevent damage to the subject firearm.

The stalls within the gun rack are designed to restrain an individual firearm within the partition, allowing for removal of the firearm by drawing the item straight out and away from the U-shaped frame only when the locking bar has been moved out of the way. The partitions and locking bar interact in such a manner that a firearm cannot be removed by twisting the firearm back and forth and withdrawing it past the steel parts forming the partitions, because the stall fits the narrowest portion of the stock of the contained gun. The long rifle rack, is designed to restrain firearms that are individually contained within their own soft case or placed ill the rack without a soft case. In order to accomplish this function, the fixed stall size must be modified by the use of a restraining spacer and such a device is provided. The pistol rack is designed to restrain the firearm in individual partitions or stalls by placing the firearm within the partition so that the steel part forming the partition passes through the trigger guard of the weapon. The condensed size of this restraint makes it easy to install ill small closets, preferably behind hanging clothes, out of public view.

The instant invention resolves all of the short comings of the prior art by providing a secure inexpensive device for the storage of firearms out of sight of the casual viewer. The device is rubberized so that the contained firearms cannot be easily damaged, unlike some of the prior art. No chains are required which could drag through or across the firearm causing damage and the device may be securely mounted to a wall so that the entire apparatus, including firearms, will be difficult to remove. An unprotected padlock is employed in the preferred embodiment; however, schemes for the protection of a locking padlock are well known in the art and the invention could readily employ such a scheme.

BRIEF DESCRIPTION OF THE DRAWINGS

FIG. 4 shows the optional upper section of the gun rack which the gun barrels can rest on.

DESCRIPTION OF THE PREFERRED EMBODIMENT

Figure 2:
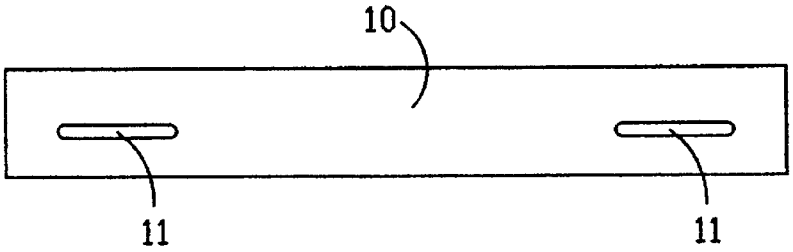
FIG. 2 is a rear view of the U-shaped restraint showing the wall attachment bolt slots.
Figure 1:
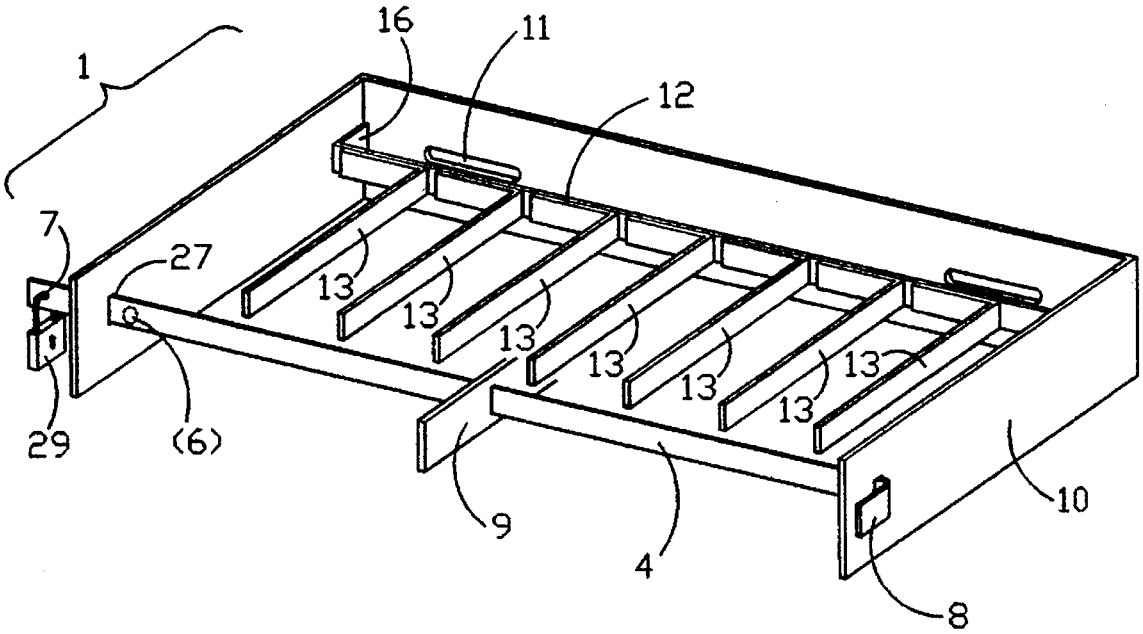
FIG. 1 is an isometric view of the preferred embodiment of the instant invention for use with long guns showing the U-shaped restraint or frame, the locking bar, and the gun partitions.

FIG. 1 shows the long gun embodiment, 1, of the instant invention. The U-shaped frame, 10, is designed to be mounted horizontally above a plane (not shown) upon which the butts of the contained firearms would rest. The plane can be the floor, a shelf, or the base of a cabinet, etcetera. The frame, 10, includes two elongated mounting bolt apertures, 11, in the foot of the "U" and has a locking bar aperture, 27, in each of the arms of the "U." The frame, 10, is divided into partitions or stalls by a series of fingers, 13, mounted to another U-shaped structure, the partition base 12. The partition base, 12, is permanently affixed to the arms of the U-shaped frame.

It would be possible to mount the partition fingers directly to the foot of the U-shaped frame and provide reinforcement to the U-shaped frame; however, a second partition base is preferred to ease construction of the device. Another variation of construction readily includes removing the arm, 16, of the U-shaped partition base and directly attaching the partition base to the arms of the U-shaped frame. The foot of the U-shaped partition base moves the firearm slightly away from the foot of the U-shaped frame, accommodates the slight angle as the gun is leaned against a wall, and provides a more secure containment for the guns when the locking bar, 4, is in place. This slight repositioning could also be obtained by attaching the partition fingers directly to the frame and attaching a displaced bar to each of the fingers at roughly the same position as the foot of the U-shaped partition base. However, while these methods of construction are within the scope of the invention, they are not preferred.

A sliding locking bar, 4, runs between two locking bar slots, 27, in each of the arms of the U-shaped frame, 12. The locking bar passes over the contained gun stocks and restrains each individual firearm within its respective partition. The locking bar is secured by a padlock, 29, using the shank aperture, 7, in the locking bar. The shank aperture, 7, is positioned within the locking bar so that the padlock shank, when inserted, is immediately next to the arm of the U-shaped frame. This reduces the movement of the locking bar away from the partition fingers; thus, reducing the opportunity for removal of the constrained gun. In the preferred embodiment, the end of the locking bar opposite the shank aperture is bent at right angles to the bar to form a right angled end, 8. This shape prevents the bar from sliding out of its slot: it would be possible to weld a stub, or any form of enlarged object, on this end to stop the bar from passing through the slot. The preferred right angel end, 8, allows the locking bar to swing outward as well as slide through the end of the frame.

An optional locking bar restraint, 9, may be added to one or more fingers to completely restrict movement of the bar away from the stalls. The restraint is a piece of metal with a slot that accepts the locking bar. The optional locking bar restraint is firmly affixed to its respective finger by welding, by using an oversized finger, or other similar permanent method. Alternatively, the locking bar can be manufactured from angle or channel iron which will substantially reduce the flexibility of the bar. The slots, 27, will be modified to accept the different locking bar. The locking bar may be inserted from either end which provides reasonable versatility for installation of the device.

Figure 16:
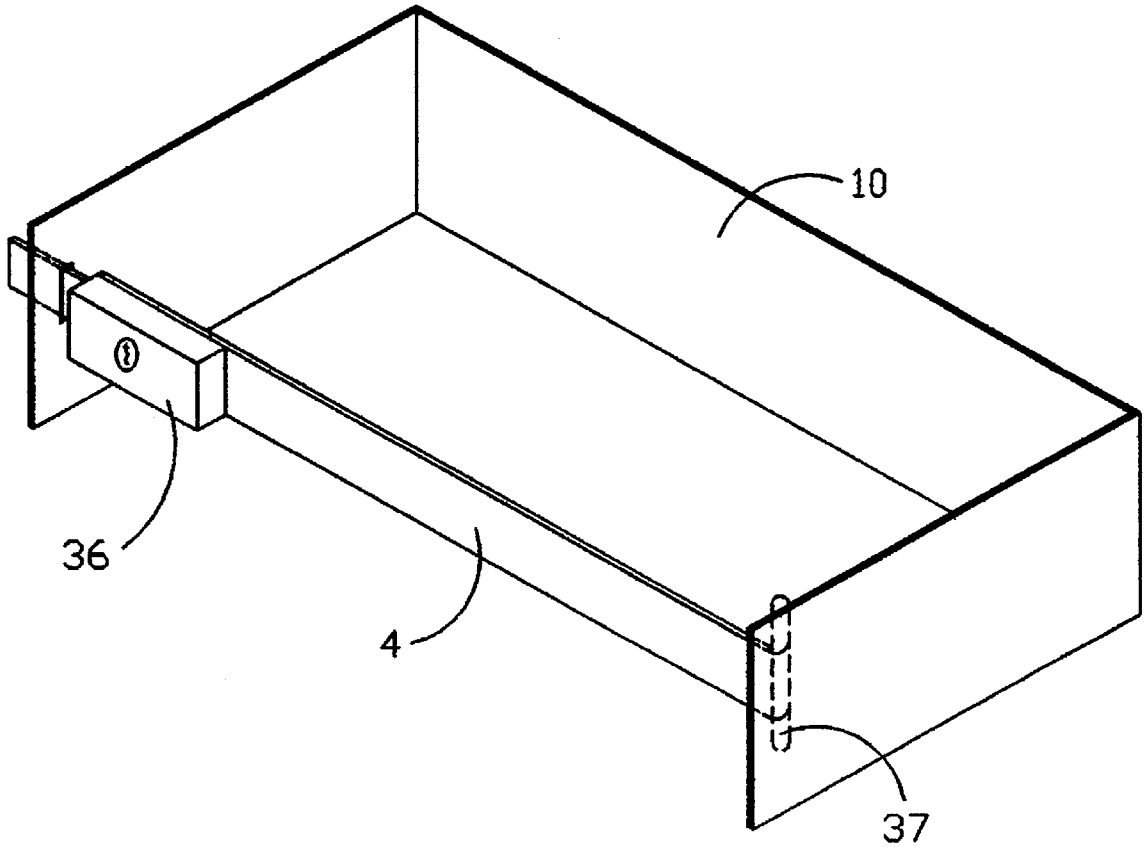
FIG. 16 shows an alternative embodiment of the gun rack which utilizes a hinged locking bar and a sliding lock mechanism. The partition fingers are not shown in this illustration.
Figure 17:
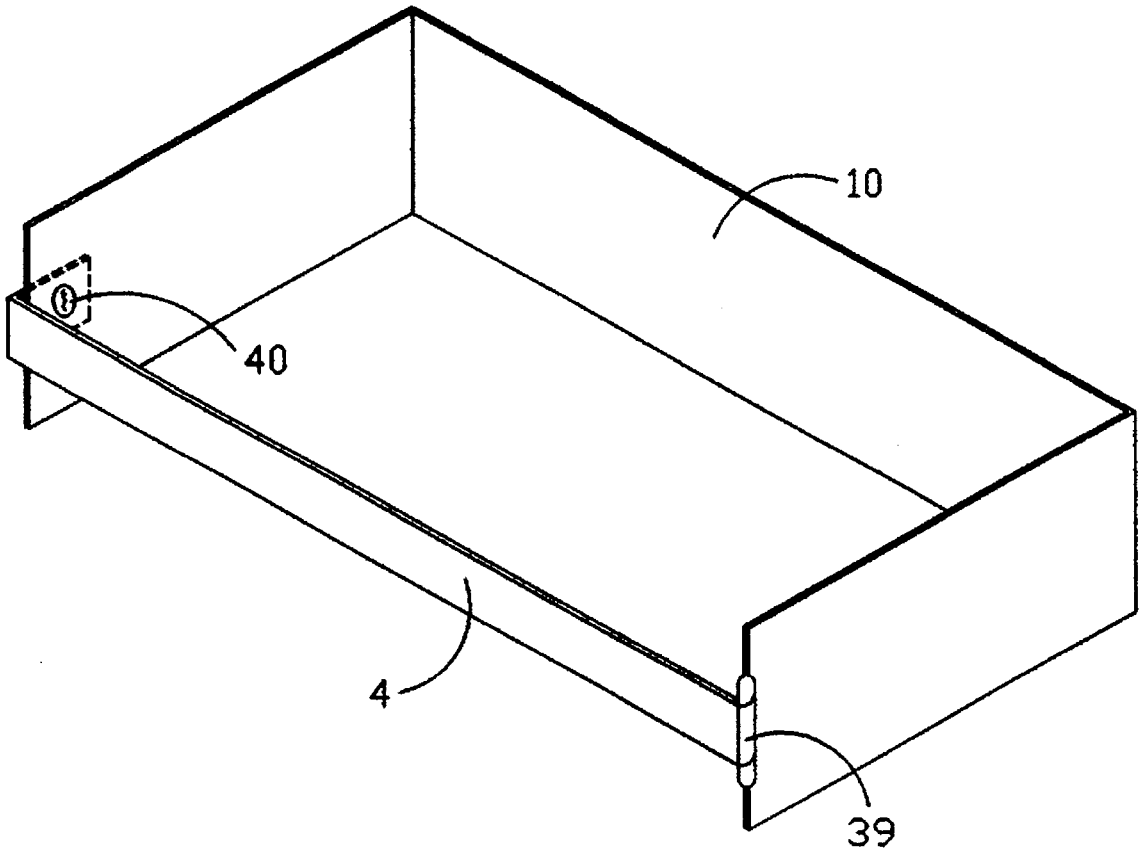
FIG. 17 shows an alternative embodiment of the gun rack which utilizes a hinged locking bar but with a padlock as the locking mechanism. The partition fingers are not shown in this illustration.

Two other alternative embodiments are shown in FIG. 16 and FIG. 17. In FIG. 16, the locking bar is hinged at one end using a hinge means, 37, and locked at the other end through a sliding locking means, 36, which incorporates a keylock, 38. In FIG. 17, the locking bar is hinged at one end using a hinge means, 39, and locked at the other end by means of a simple padlock placed in the padlock shank aperture, 40. These alternatives are not preferred because of the increase in manufacturing costs. However, these alternatives do reduce the clearance required to open the rack and would be very useful when the gun rack is employed in tight or restricted spaces. It should be noted that the curved end found at one end of the locking bar in the preferred embodiment of FIG. 1 also provides a swing out motion as well as a sliding motion. Although the locking bar is shown as a flat bar, angle iron or U-channel could be employed. The use of angle iron or U-channel would increase the security of the alternative embodiment because the locking bar would be less susceptible to bending away from the partitions or stalls (not shown in FIG. 16).

In the preferred embodiment, all the parts that could come in contact with a contained firearm are coated or covered with a resilient material. The resilient coating is formed of rubber or rubber-like material by coating the contact surfaces with a rubberizing compound, but any suitable material and method of attachment may be used. For example, rubber (or equivalent) strips 25, may be attached to the contact surfaces as in the pistol embodiment to be described.

Figure 14B:
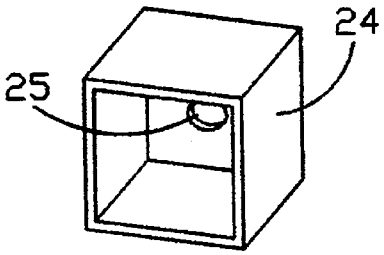
FIG. 14B shows an alternative optional mounting bolt guard for the Long Gun embodiment of FIG. 1.
Figure 14A:
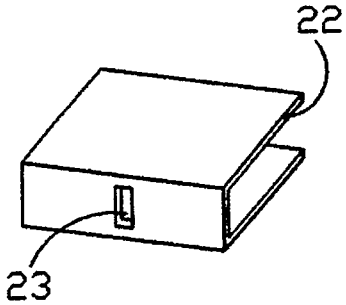
FIG. 14A shows an optional mounting bolt guard for the Long Gun embodiment of FIG. 1.

The frame, 1, is designed to be mounted to a structure such as a wall for maximum security by bolts passing through the elongated slot, 11. (The elongated slots allow for mounting to walls utilizing different standards of stud spacing.) Once a gun is stored in the rack and depending on the size of the firearm, it is difficult to gain access to the head of the mounting bolt. Two forms of optional protection for the bolt are provided to make certain that the bolts cannot readily be removed. FIG. 14A shows a U-shaped bolt protector, 22, that slides over a partition finger via a partition slot, 23. Once in place, the arms of the protector keep any wrenches away from the bolt head. In a similar manner, the box like protector shown in FIG. 14B will protect the bolt head. This optional device passes over the bead of the bolt and allows a socket set to reach the bolt head. The bolt is then installed in the normal manner. Once the bolt is installed and a firearm positioned in the rack, access is denied to the bolt head from the front by the firearm and from the sides by the protector. An elongated bolt head protector could be affixed to the U-shaped frame, 10, running around the elongated holes, 11, but this would increase the cost of manufacture. A special bolt, such as a "clutch head" bolt, which requires the use of a special matching insertion/retraction tool could also be employed. The object of the mounting design is to make it difficult and time consuming to remove the gun rack from the mounting wall or other structure with guns locked in the rack. Most burglars are only equipped with pry (or crow) bars and the instant invention will resist any force applied by such tools. The security of prior art devices, which use wood as a construction material, would easily be overcome by force from a pry bar.

The position of the gun frame above the plane upon which the firearm butts will rest is somewhat important. The frame should be positioned so that the locking bar passes below the trigger guard and above the enlarged portion of the stock. Thus, when the locking bar is in place, the enlarged portion of the stock cannot pass past the locking bar. Preferably, the frame should be anchored to a wall (or similar structure) for maximum security. In a home that uses wall stud construction, the bolts should enter the studs. The elongated bolt apertures, 11, will allow the device to be used on any standard stud spacing.

Figure 3:
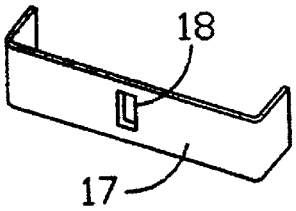
FIG. 3 shows the preferred form of the gun spacer used to reduce the size of two partitions.

As stated previously, some gun owners like to store guns in soft cases. This means that slightly extra length will have to be provided to the partition fingers to allow room for the soft case to be fully received within each stall. Guns in soft cases will fit snugly within the stall preventing unauthorized removal; however, when a gun without a soft case is stored, it might be possible to slip the stock past the locking bar. In a similar manner, a smaller sized gun will not be secure in the device. An optional spacer, see FIG. 3, is provided to reduce the depth of the partition and prevent slippage past the locking bar.

Figure 6:
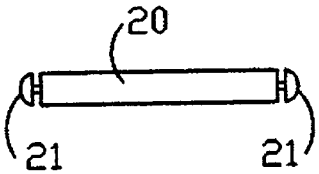
FIGS. 5 and 6 illustrate an alternate embodiment to the optional spacer.
Figure 5:
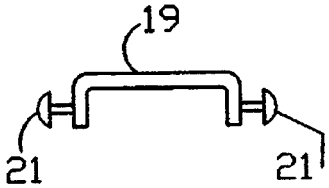

In the preferred embodiment, the optional spacer, 17, is designed to reduce the depth of two adjacent partitions. The spacer slips over a partition finger through the finger slot, 18, and is restrained between the foot of the partition base, 12, and the contained firearm (not shown). There are a series of alternate embodiments for the spacer, see FIGS. 5 and 6, which are designed to operate with alternate embodiments of the partition fingers shown FIGS. 8 and 9.

Figure 8:
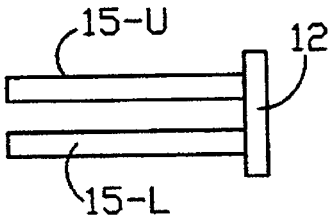
FIGS. 7 and 8 illustrate alternate embodiments of the partition bars required for use with the alternate forms of the optional spacer.
Figure 7:
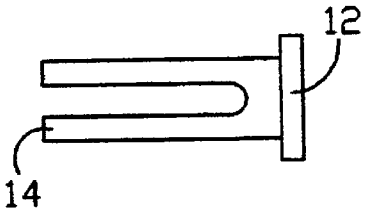
Figure 9:
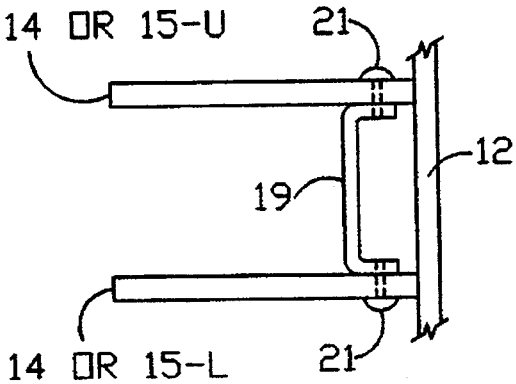
FIG. 9 shows a side view of the alternate embodiment of the optional spacer of FIG. 5 in place in the gun rack.

The partition fingers can readily be provided in two different forms as shown in FIGS. 7 and 8. In FIG. 7 the partition finger, 14, has a slot formed within the finger. In FIG. 8, the partition finger is formed from two parallel rods, 15-U and 15-L. The parallel rods form a slot between them. The optional spacer, 19 or 20, has a spacer stud, 21, on each end of the spacer. The spacer stud fits (or slides) within the finger slot in the two alternate forms of the partition finger and is held in place by the interaction between that slot and the stud. This form of spacer will reduce the size of a single partition as shown in FIG. 9. The spacer is preferably coated or rubberized to reduce any possibility of damage to the firearm.

Figure 4:
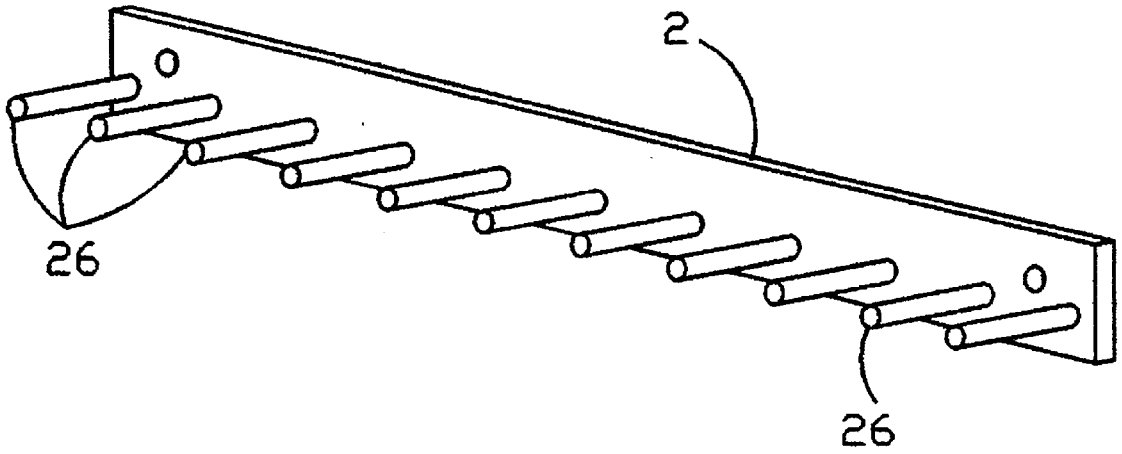
Figure 15:
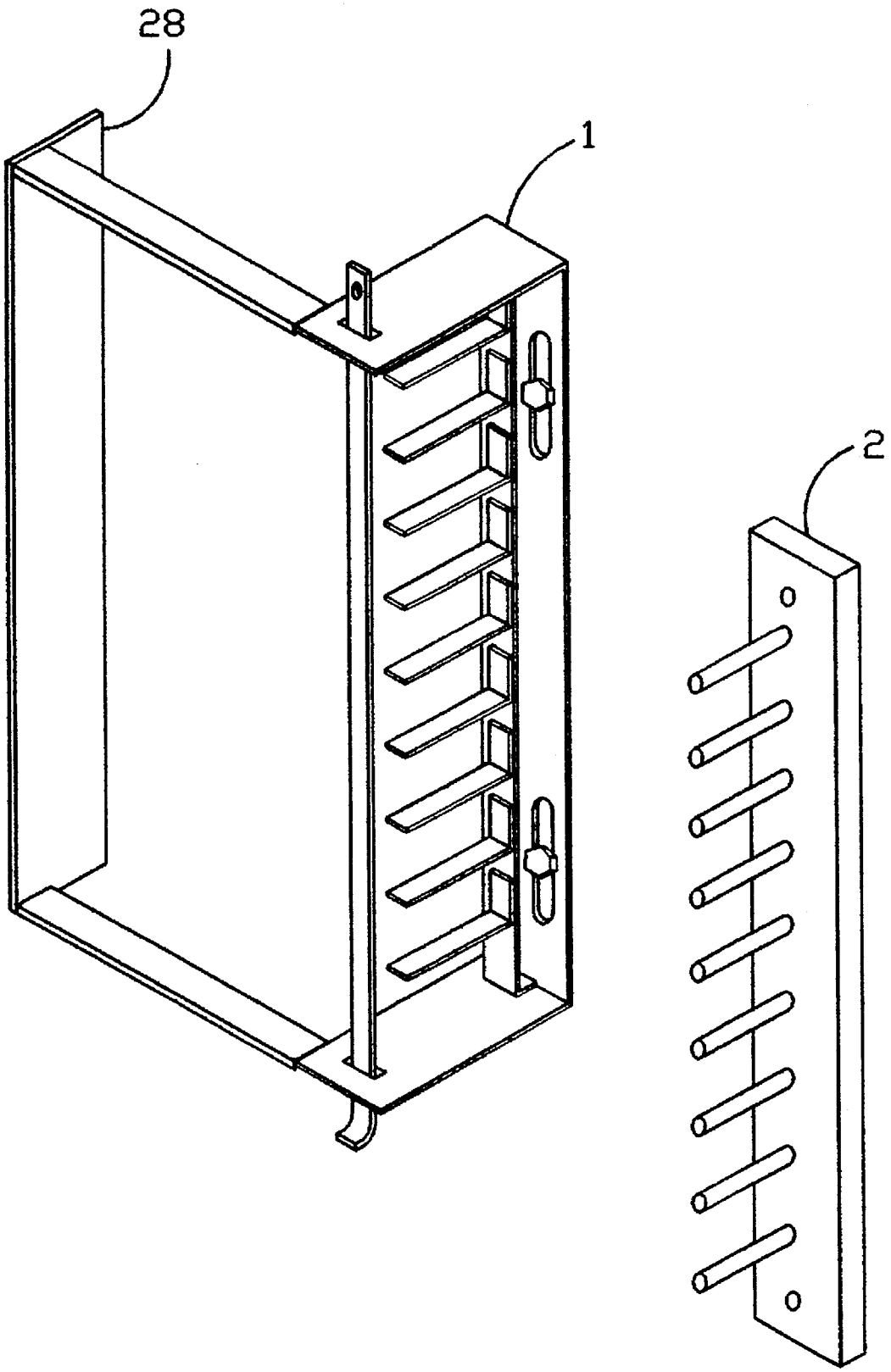
FIG. 15 shows the use of a restraint plate optionally utilized whenever the long gun embodiment is placed horizontally on a wall or similar object.

The frame call be used in conjunction with a gun barrel rest, 2, shown in FIG. 4. Normally, the frame would be placed parallel to the ground plane at the position noted above, and the gun barrel rest would be mounted above the frame. Guns would then be restrained within the rack with their butts resting on the ground plane and their barrels resting on the barrel rest. It is possible to rotate the entire assembly by ninety-degrees, so that stored guns are disposed horizontally, but some provision would be required to prevent removal of the gun to the side. Judicial mounting of the frame near a wall or other similar object can accomplish this purpose. Alternatively, a second plate, 28, can be added to the device to prevent movement of the firearm as shown in FIG. 15.

In the alternative, the gun barrel rest could readily be made from metal and, like the instant invention, include a locking bar assembly. The metal is coated and the locking bar is designed to slide through locking bar apertures at either end of the metal gun barrel rest or be hinged at one end and locked at the other. This alternative will dramatically improve the security of locked guns, but would significantly increase the cost of the unit. In fact, the gun barrel rest and the second plate could be manufactured as an assembly.

It should be noted that the foregoing description envisions the gun rack as mounted to a wall or the like. It would be very easy to place the instant invention within a gun case or have the invention form part of a decorative gun rack. If the invention were used with decorative-type gun displays, security would be substantially improved over the prior art.

Figure 10:
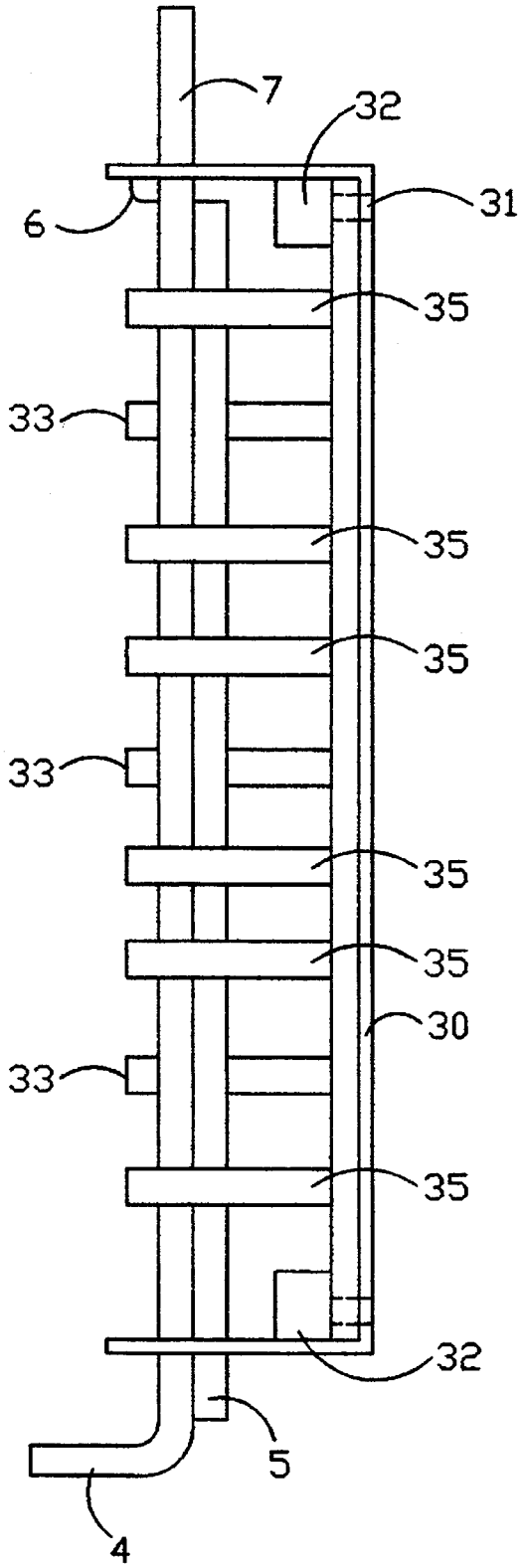
FIG. 10 is a side view of the preferred embodiment of the instant invention for use with pistols showing the U-shaped restraint, the locking bar, and the gun partitions.
Figure 13:
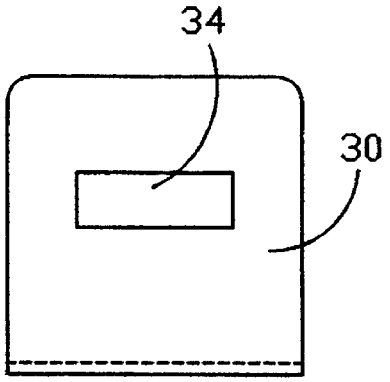
FIG. 13 is an end view of the instant invention showing details of the locking bar aperture as used in the pistol embodiment of the instant invention. The same concept is employed in the Long Gun Embodiment of FIG. 1.
Figure 12:
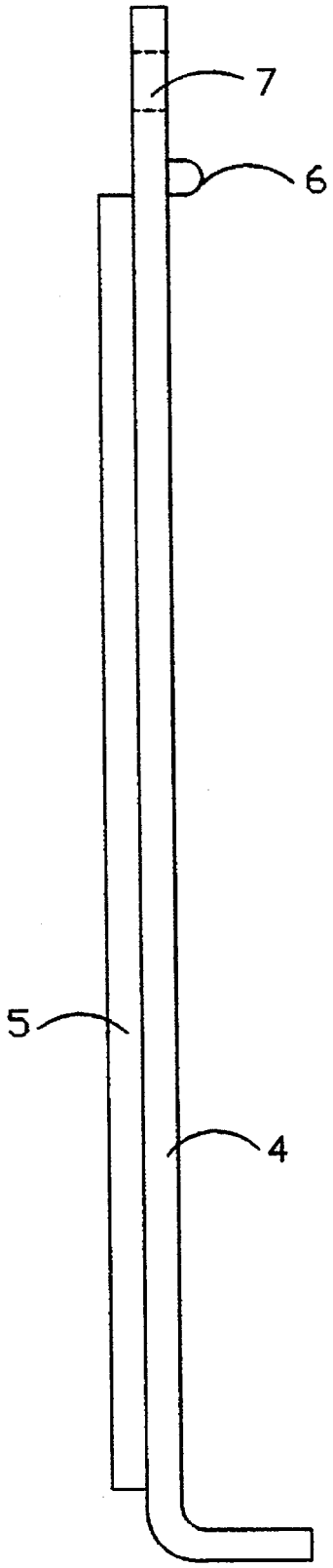
FIG. 12 is an enlarged view of the locking bar as used in the pistol embodiment of the instant invention. The same details are employed in the Long Gun Embodiment of FIG. 1.
Figure 11:
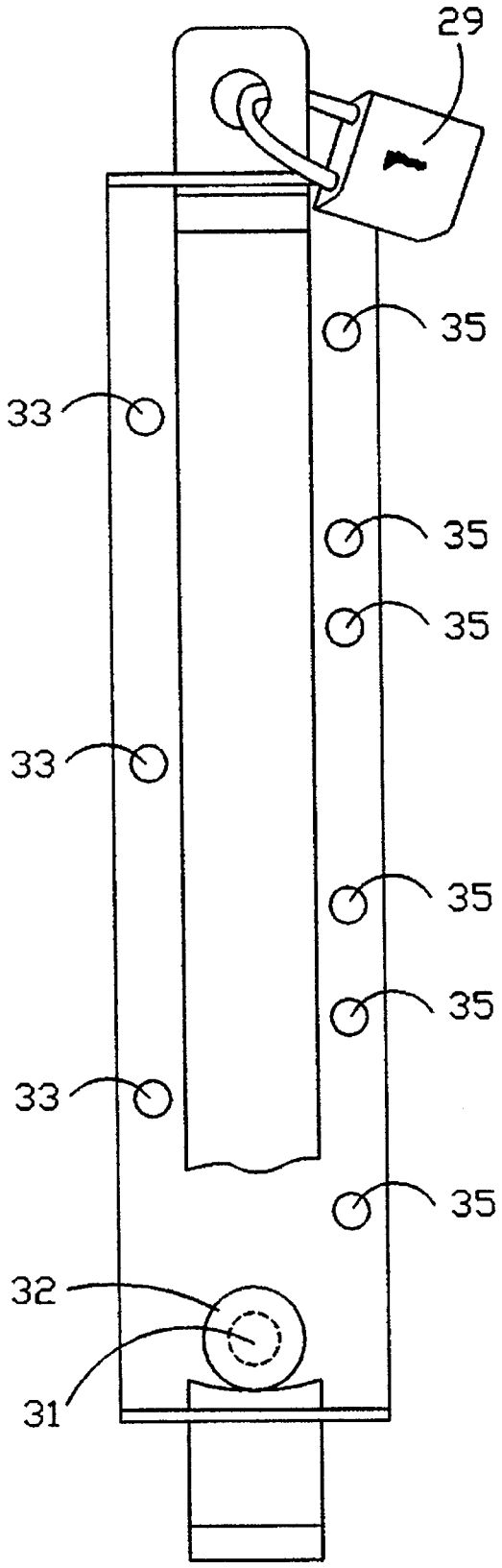
FIG. 11 is a plan view of the embodiment of FIG. 10.

The pistol embodiment of the instant invention is shown in FIGS. 10 through 12, and the embodiment is identical in principle to the long gun embodiment. The pistol embodiment includes an elongate U-shaped frame, 30, of substantially greater length than width, with a base having mounting apertures, 31, and parallel legs extending perpendicular to the base. Each leg includes a locking bar aperture, 34, to receive a locking bar, 4, which preferably includes a resilient strip, 5, or coating. Partitions for each pistol are formed by partition rods, 33 and 35. Partition rods 33 are disposed in a row along and adjacent to one of the long edges of the base of the frame, 30, and are evenly spaced within that row. Partition rods 35 are disposed in a separate row along and adjacent to the opposite edge of the base of the frame in a paired arrangement, with sufficient space between each pair of partition rods 35 to receive the barrel of a pistol between the rods. As illustrated in FIG. 11, a single partition rod 35 may be used at each end of the base of frame 30, since the adjacent leg of the frame serves the same function as a second partition rod in those end locations. The partition rods are provided with a resilient covering to protect the firearm and are directly attached to the foot of the U-shaped pistol frame, 30. Like its long gun embodiment, the pistol frame is designed to be mounted to a wall or similar object for maximum security by attachment bolts through the apertures, 31. The mounting bolts can be protected by a circular mounting bolt guard, 32, which permits access to the bolt heads only when the locking bar, 4, is open. In the preferred embodiment, the frame and locking bar are covered with rubber or other resilient material to avoid damage to the contained firearm. For example, it would be possible to coat these two parts with a rubberizing compound.

It is preferred that the pistol rack be mounted vertically on a wall or similar supporting structure, preferably in a closet behind hanging clothes and out of view. When the pistol rack is mounted on a wall using stud construction, the rack should be mounted to a single stud through the two mounting apertures, 31, with the locking bar shank aperture, 7, at the top of the unit so that the bar falls downward through the locking bar aperture, when the padlock, 29, is removed. The pistol embodiment incorporates a locking bar stop pin, 6, on the locking bar, 4. This pin stops the locking bar from falling out of the frame, 30, whenever the bar is unlocked. The pin is not a requirement but helps in the operation of the device, because the frame is generally mounted vertically which means that there will be tendency for the bar to fall out of the frame. The same pin can be incorporated in the long gun embodiment, which will be a useful addition whenever the gun rack is mounted horizontally. A pistol is placed within a partition or stall with its trigger guard around one of the single sets of partition rods, 33, and with the barrel falling between the opposite pair of rods, 35. The frame is locked by closing the locking bar and placing a padlock through the shank aperture, 7.

The instant device offers remarkable security for firearms at a low cost. The locking bar, 4, is difficult to force open by a pry bar without causing severe damage to the firearm. It is difficult to remove the entire frame from a mounting wall without subjecting the contained firearms to some risk of damage. Bolt cutters can be used to shear the padlock shank and open the locking bar: however, there are in the art numerous techniques to protect an exposed padlock shank and such protection would be within the scope of this invention. Most of the padlock protection art has been developed for the trucking and storage industry, and an excellent example may be found in U.S. Pat. No. 4,581,907 (Eberly) which discloses a Padlock Protector. It is believed that the effectiveness of the instant invention in preventing unauthorized use and even casual theft of contained firearms is not diminished by use of the preferred embodiment without padlock protection.

Finally, a covered or rubber/plastic coated chain may be included in an alternative embodiment of the gun rack. The chain would be used to provide additional protection for contained firearms by running the chain through the trigger guard. Care would have to be exercised to avoid scratching or damaging the gun. The ends of the chain would be placed about or through the locking bar or even terminated through the locking padlock. The extra chain would be very useful in securing a smaller sized gun whose stock might readily slide past the locking bar. In fact, such a chain could be used instead of the optional spacer or while a spacer is being ordered for a new gun.

There has been disclosed, heretofore in the above discussion, the best embodiment and best mode of the present invention presently contemplated. It is to be understood that the examples given may be changed. It should also be understood that modifications can be made thereto without departing from the spirit of the present invention.

I claim:

1. A partitioned locking gun rack for securing a plurality of guns in a side-by-side relationship, each gun having a trigger guard, a gun barrel, and a stock having a butt and a narrow portion within the stock, comprising:

a U-shaped mounting base having a foot and two sides, further having mounting means for attaching said base to a structure and having a locking bar aperture within each of said sides;

a partition base, attached to said U-shaped mounting base and extending between said sides thereof;

a plurality of partition fingers, each having a tip and an end, said partition fingers being attached at said end thereof to said partition base and extending in parallel relation to form a plurality of partitions for receiving the gun stock, said fingers providing means to slidingly receive partition spacers to selectively adjust the depth of said partitions;

a locking bar, having a first end and a second end, slideably received by said locking bar apertures within said sides of said U-shaped base, said apertures positioned within said sides of said U-shaped base whereby said locking bar extends transversely across and adjacent to said tips of each of said partition fingers, whereby said locking bar closes off said plurality of partitions and whereby said closed partition restrains the narrow portion of the gun stock from movement; and means for securing said locking bar within said U-shaped base.

2. The partitioned locking gun rack of claim 1 wherein said mounting means further comprises a plurality of elongated mounting bolt apertures extending through said foot of said U-shaped base.

3. The partitioned locking gun rack of claim 1 wherein said means for securing said locking bar further comprises:

a padlock shank aperture within said first end of said locking bar; and, a stop means at said second end of said locking bar whereby said second end of said bar will not pass through said locking bar aperture.

4. The partitioned locking gun rack of claim 3 wherein said stop means comprises a right angle bend formed at said second end of said locking bar.

5. The partitioned locking gun rack of claim 3 wherein said stop comprises a stub attached to said second end of said locking bar.

6. The partitioned locking gun rack of claim 1 wherein said means for securing said locking bar comprises a padlock shank aperture within said first end thereof whereby a padlock lock shank, when placed through said padlock shank aperture, secures said locking bar.

7. The partitioned locking gun rack of claim 1 wherein said partition fingers are manufactured from elongated flat metal plate.

8. The partitioned locking gun rack of claim 7 wherein each of said partition fingers includes a notch running from said tip thereof towards said end thereof providing means for slidingly receiving a partition spacer.

9. The partitioned locking gun rack of claim 1 wherein each partition finger comprises a first rod and a second rod, each rod having a tip and an end, with said end of said first rod attached to said partition base and with said end of said second rod attached to said partition base such that a gap exists between said first and second rod for slidingly receiving a partition spacer.

10. The partitioned locking gun rack of claim 7 further comprising a U-shaped partition spacer having two arms and a foot and having a slot centered within said foot to be received over one of said plurality of partition fingers, thereby reducing the depth of two adjacent partitions.

11. The partitioned locking gun rack of claim 8 further comprising a partition spacer having a first end and second end and having a spacer stud attached at said first end and a spacer stud attached at said second end thereof, each said spacer stud configured and dimensioned to be received by said slot in one of said plurality of partition fingers.

12. The partitioned locking gun rack of claim 9 further comprising a partition spacer having a first end and second end and having a spacer stud attached at said first end and a spacer stud attached at said second end thereof, said spacer stud configured and dimensioned to be received by said gap in one of said plurality of partition fingers.

13. The partitioned locking gun rack of claim 7 wherein said tip of one or more of each of said partition fingers are extended in length and provided with a locking bar aperture for the purpose of receiving said locking bar to prevent outward movement thereof.

14. A partitioned locking gun rack for securing a plurality of guns in a side-by-side relationship, each gun having a trigger guard, a gun barrel, and a stock having a butt and a narrow portion within the stock, comprising:

a U-shaped mounting base having a foot and two parallel sides extending perpendicular to said foot and in same direction, further having mounting means for attaching said base to a structure and having a locking bar aperture within each of said sides;

a plurality of partition fingers, each having a tip and an end, said partition fingers being attached at said end thereof to said U-shaped mounting base and extending in parallel relation to form a plurality of partitions for receiving the gun stock, said fingers providing means to slidingly receive a partition spacer;

a partition base, attached to said U-shaped mounting base, with said plurality of partition fingers connected to said partition base.

a locking bar, having a first end and a second end, slideably received by said locking bar aperture within said sides of said U-shaped base, said aperture positioned within said sides of said U-shaped base whereby said locking bar extends transversely across and adjacent to said tips of each of said partition fingers, whereby said locking bar closes off said plurality of partitions and whereby said closed partition restrains the narrow portion of the gun stock from movement; and, a padlock shank aperture within said first end of said locking bar.

15. A method of using a partitioned locking gun rack incorporating a locking bar and a plurality of partition fingers to secure a plurality of guns in a side by side relationship; each gun within its own adjustable depth partition: and each gun having a trigger guard, a gun barrel, and a stock having a butt and a narrow portion within the stock, comprising:

$a_h$) mounting the partitioned gun rack to a structure in horizontal relationship so that the butt of the gun stock, when placed in the partitioned gun rack, will rest against the floor with the narrow portion of the stock resting within the partition;

$b_h$) placing the gun within a partition so that the narrow portion of the gun stock is within the confines of said partition and that the butt rests against the floor;

c) placing the locking bar across the partitions; and, d) securing the locking bar.

16. The method of using a partitioned locking gun rack of claim 15 in a vertical relationship wherein the gun rack further includes a mounting base and a partition base attached to the mounting base, wherein each partition finger has an end and a tip, wherein the end of each partition finger is attached to the partition base, and wherein steps ($a_h$) and ($b_h$) are omitted and replaced with steps ($a_v$) and ($b_v$):

$a_v$) mounting the partitioned gun rack to a structure in a vertical relationship so that the butt of the gun stock, when placed in the partitioned gun rack will rest against said structure thus placing the narrow portion of the stock within a partition between the partition base and the tips of adjacent partition fingers;

$b_v$) placing the gun within the partition so that the narrow portion of the gun stock is within the confines of said partition between the partition base and the tips of adjacent partition fingers and that the butt rests against the structure.

17. The method of using a partitioned locking gun rack of claim 15, wherein a gun to be secured has a stock sufficiently small to be removed from a partition with the locking bar in place, and wherein the gun rack further includes a spacer, comprising the additional step, before step (c), of:

placing a partition spacer in a partition thereby reducing the overall depth of the partition.

18. A partitioned locking gun rack for securing a plurality of guns in side-by-side relationship, each gun having a trigger guard and a gun barrel, comprising:

a U-shaped frame having a base and two legs, said base having first and second opposed edges extending between said legs, said frame further having mounting means for attaching said frame to a structure and having a locking bar aperture within each of said legs;

a plurality of first partition rods, each having a tip and an end, disposed in an evenly spaced row along said first edge of said base with each of said rods attached at said end thereof to said base and extending in parallel relationship therefrom, each of said first rods to extend through the trigger guard of a gun placed in the rack;

a plurality of second partition rods, each having a tip and an end, disposed in pairs in a row along said second edge of said base with each of said rods attached at said end thereof to said base and extending in parallel relationship therefrom, with said second partition rods disposed relative to said first partition rods such that the barrel of a gun placed in the rack will be received between a pair of second partition rods with a first partition rod extending through the trigger guard of the gun;

a locking bar, having a first end and a second end, slideably received by said locking bar apertures within said legs of said U-shaped frame, said apertures positioned within said legs of said U-shaped frame whereby said locking bar extends parallel to said base between and approximately equidistant from said tips of said first partition rods and said tips of said second partition rods, thereby preventing removal of a gun secured in the rack; and means for securing said locking bar within said U-shaped frame.

19. The partitioned locking gun rack of claim 18 wherein said mounting means further comprises a plurality of elongated mounting bolt apertures extending through said foot of said U-shaped base.

20. The partitioned locking gun rack of claim 18 wherein said means for securing said locking bar comprises a padlock shank aperture within said first end thereof whereby a padlock shank, when placed through said padlock shank aperture secures said locking bar.

21. The partitioned locking gun rack of claim 18 wherein said means for securing said locking bar further comprises:

a padlock shank aperture within said first end of said locking bar; and, a stop means at said second end of said locking bar whereby said second end of said bar will not pass through said locking bar aperture.

22. The partitioned locking gun rack of claim 21 wherein said stop means comprises a right angle bend formed at said second end of said locking bar.

23. A method of using a gun rack incorporating a locking bar, a base with opposed first and second edges, a row of evenly spaced first partition rods connected to the base along its first edge, and a row of second partition rods connected to the base in separated pairs along its second edge, for securing a gun having a trigger guard and a gun barrel, comprising:

a) placing a gun within the rack against the base with the trigger guard received over a first partition rod and the barrel received between a pair of second partition rods;

b) placing the locking bar generally parallel to the base and approximately equidistant between the row of first petition rods and the row of second partition rods so as to prevent removal of the trigger guard from over the first partition rod and removal of the barrel from between the pair of second partition rods; and, c) securing the locking bar.

24. A partitioned locking gun rack for securing a plurality of guns in a side-by-side relationship, each gun having a trigger guard, a gun barrel, and a stock having a butt and a narrow portion within the stock, comprising:

a U-shaped mounting base having a foot and a first side and a second side, further having mounting means for attaching said base to a structure;

a plurality of partition fingers, each having a tip and an end, said partition fingers being attached at said end thereof to said U-shaped mounting base and extending in parallel relation to form a plurality of partitions for receiving the gun stock, said fingers providing means to slidingly receive a partition spacer:

a locking bar, having a first end and a second end whereby said locking bar extends transversely across and adjacent to said tips of each of said partition fingers, whereby said locking bar closes off said plurality of partitions and whereby said closed partition restrains the narrow portion of the gun stock from movement;

a hinge means joining said second end of said locking bar to said second side of said U-shaped mounting structure in pivotal relationship thereto; and, a locking means for securing said first end of said locking bar to said first side of said U-shaped structure.

* * * * *